US011540681B2

(12) United States Patent
Dahlbeck et al.

(10) Patent No.: US 11,540,681 B2
(45) Date of Patent: Jan. 3, 2023

(54) VACUUM CLEANER AND VALVE

(71) Applicant: Aktiebolaget Electrolux, Stockholm (SE)

(72) Inventors: Erik Dahlbeck, Stockholm (SE); Henrik Holm, Stockholm (SE)

(73) Assignee: Aktiebolaget Electrolux

( * ) Notice: Subject to any disclaimer, the term of this patent is extended or adjusted under 35 U.S.C. 154(b) by 2 days.

(21) Appl. No.: 16/771,102

(22) PCT Filed: Dec. 14, 2017

(86) PCT No.: PCT/EP2017/082780
§ 371 (c)(1),
(2) Date: Jun. 9, 2020

(87) PCT Pub. No.: WO2019/114965
PCT Pub. Date: Jun. 20, 2019

(65) Prior Publication Data

US 2020/0367707 A1 Nov. 26, 2020

(51) Int. Cl.
*A47L 5/22* (2006.01)
*A47L 5/24* (2006.01)
(Continued)

(52) U.S. Cl.
CPC ..... *A47L 5/225* (2013.01); *A47L 5/24* (2013.01); *A47L 5/36* (2013.01); *A47L 9/0072* (2013.01);
(Continued)

(58) Field of Classification Search
CPC . A47L 5/225; A47L 5/24; A47L 9/322; A47L 5/28
(Continued)

(56) References Cited

U.S. PATENT DOCUMENTS 7,676,883 B2 * 3/2010 Macleod ..... A47L 5/32 15/334
9,516,979 B2 12/2016 Gidwell
(Continued)

FOREIGN PATENT DOCUMENTS

CN 101803892 A 8/2010
CN 104799760 A 7/2015
(Continued)

OTHER PUBLICATIONS

Translated description of KR20140113856A (Year: 2022).*
(Continued)

*Primary Examiner* — Orlando E Aviles
*Assistant Examiner* — Sarah Akyaa Fordjour
(74) *Attorney, Agent, or Firm* — RatnerPrestia

(57) ABSTRACT

A vacuum cleaner having a hand unit and an elongated member having a nozzle end portion and a handle end portion. The vacuum cleaner has a valve arranged at the nozzle end portion, the valve having a valve member being movable between a first and a second position. In the first position the valve member directs an airflow from a floor nozzle to the hand unit while preventing an airflow to flow through the handle end portion. In the second position the valve member directs the airflow from the floor nozzle to the handle end portion and to the hand unit. Vacuum cleaning may be performed with the floor nozzle both when the hand unit is connected at the nozzle end and at the handle end.

19 Claims, 6 Drawing Sheets

(51) Int. Cl.

| | |
|---|---|
| ***A47L 5/36*** | (2006.01) |
| ***A47L 9/00*** | (2006.01) |
| ***A47L 9/04*** | (2006.01) |
| ***A47L 9/28*** | (2006.01) |
| ***A47L 9/30*** | (2006.01) |

(52) U.S. Cl.
CPC ..... *A47L 9/0411* (2013.01); *A47L 9/0477* (2013.01); *A47L 9/2842* (2013.01); *A47L 9/2884* (2013.01); *A47L 9/30* (2013.01)

(58) Field of Classification Search
USPC ..... 15/329
See application file for complete search history.

(56) References Cited

U.S. PATENT DOCUMENTS

| | | | | |
|---|---|---|---|---|
| 11,058,267 | B2 | 7/2021 | Svantesson et al. | |
| 2007/0289087 | A1* | 12/2007 | Macleod | A47L 5/32 251/158 |
| 2010/0306955 | A1 | 12/2010 | Menrik et al. | |
| 2016/0174787 | A1* | 6/2016 | Conrad | A47L 5/28 15/329 |
| 2018/0055311 | A1* | 3/2018 | Conrad | A47L 9/1625 |

FOREIGN PATENT DOCUMENTS

| | | | | | |
|---|---|---|---|---|---|
| CN | 105832246 | A | | 8/2016 | |
| CN | 106618377 | A | | 5/2017 | |
| CN | 106763893 | A | | 5/2017 | |
| CN | 107105951 | A | | 8/2017 | |
| CN | 108392135 | A | | 8/2018 | |
| CN | 108392135 | B | * | 6/2020 | A47L 5/00 |
| DE | 102016105475 | A1 | | 9/2017 | |
| DE | 102016105475 | A1 | * | 9/2017 | A47L 5/34 |
| EP | 1279362 | A1 | | 1/2003 | |
| JP | 5644642 | U | | 4/1981 | |
| JP | 04122346 | A | | 4/1992 | |
| JP | 2012050564 | A | | 3/2012 | |
| JP | 2015119879 | A | | 7/2015 | |
| KR | 20140113856 | A | * | 9/2014 | |
| KR | 20140113856 | A | | 9/2014 | |
| KR | 20190002458 | A | | 1/2019 | |
| WO | 2005117676 | A1 | | 12/2005 | |
| WO | 2008088278 | A2 | | 7/2008 | |
| WO | 2016184075 | A1 | | 11/2016 | |
| WO | 2017186280 | A1 | | 11/2017 | |

OTHER PUBLICATIONS

Translation description of KR20140113856A (Year: 2022).*
Japanese Notice of Reasons for Refusal for Japanese Application No. 2020-526105, dated Aug. 11, 2021, with translation, 5 pages.
International Search Report and Written Opinion for International Application No. PCT/EP2017/082780, dated Sep. 4, 2018, 10 pages.
International Preliminary Report on Patentability for International Application No. PCT/EP2017/082780, dated Jun. 16, 2020, 7 pages.
Chinese Office Action for Chinese Application No. 201780097284.2, dated Jun. 9, 2021 with translation, 16 pages.
Korean Notification of Reason for Refusal for Korean Application No. 10-2020-7015552, dated Oct. 29, 2021, with translation, 13 pages.
Chinese Office Action for Chinese Application No. 201780097284.2, dated Feb. 18, 2022 with translation, 17 pages.

* cited by examiner

VACUUM CLEANER AND VALVE

This application is a U.S. National Phase application of PCT International Application No. PCT/EP2017/082780, filed Dec. 14, 2017, which is incorporated by reference herein.

TECHNICAL FIELD

The present disclosure relate relates to a vacuum cleaner, and to a valve configured for fluidly connecting a hand unit to an elongated member of a vacuum cleaner.

BACKGROUND

Vacuum cleaners of different types are known. One type of vacuum cleaner is referred to as the stick type. The stick type vacuum cleaner comprises essentially a slender body with a handle at one end, and a floor nozzle at the other end. Inside the body a motor fan unit is arranged for producing an airflow through the vacuum cleaner, and a main separation unit for separating dust and debris from the airflow. The stick type vacuum cleaner is designed for standing use, the user grasping the handle and moving the nozzle over a surface to be cleaned.

An advantage of the stick type vacuum cleaner is that it is compact and thus, easily stowed. It may be used as a complement to a larger vacuum cleaner for quickly vacuum cleaning a smaller area, or as a main vacuum cleaner in smaller living spaces, such as e.g. a one or two room apartment.

Some vacuum cleaners of the stick type include a hand unit, which in itself may be used for vacuum cleaning, e.g. on other surfaces than floor surfaces. Such a vacuum cleaner may be referred to as a two-in-one vacuum cleaner. More specifically, the hand unit is releasably connected to the body of the vacuum cleaner. During use of the stick type vacuum cleaner the hand unit is mounted in the body of the vacuum cleaner. The hand unit produces an airflow through the floor nozzle, which airflow is lead into a main separation unit arranged in the hand unit. For vacuum cleaning e.g. a table or other furniture, the hand unit is released from the body of the vacuum cleaner and used as a standalone handheld vacuum cleaner.

WO 2008/088278 discloses a stick type vacuum cleaner of the two-in-one type comprising a releasable hand held unit and a support body.

WO 2016184075 discloses a three-in-one vacuum cleaner of the stick type. The vacuum cleaner comprises a hand held vacuum cleaner, a floor nozzle and a handle rod. The handle rod is a hollow and rod-shaped object. The hand held vacuum cleaner, the handle rod, and the floor nozzle can be separated from each other and be assembled in certain constellations. The vacuum cleaner can be operated in three working modes: a first mode, combining all three elements including the hand held vacuum cleaner, the handle rod and the floor nozzle to form a stick vacuum cleaner; a second mode, detaching the hand held vacuum cleaner from the handle rod and from the floor nozzle to form a separate handheld vacuum cleaner; and a third mode, combining the hand held vacuum cleaner and the handle rod without the floor nozzle to form a hand held vacuum cleaner with the handle rod forming a suction pipe extending the reach of the hand held vacuum cleaner.

Vacuum cleaning under furniture may prove difficult with the stick type vacuum cleaner. The body of the stick type vacuum cleaner may prevent the floor nozzle from reaching under e.g. a sofa or a cupboard.

SUMMARY

There exists a need for a versatile vacuum cleaner of the stick type. It would be advantageous to achieve a vacuum cleaner overcoming, or at least alleviating, the above mentioned drawback. In particular, it would be desirable to enable a user of a stick type vacuum cleaner to vacuum clean narrow horizontal spaces, such as under low furniture. To better address one or more of these concerns, a vacuum cleaner having the features defined in independent claim 1 is provided.

According to an aspect of the disclosure there is provided a vacuum cleaner comprising an elongated member having a nozzle end portion and a handle end portion, a floor nozzle arranged at the nozzle end portion, a handle arranged at the handle end portion, and a hand unit releasably connectable at the nozzle end portion and at the handle end portion. The hand unit comprises a motor fan unit for producing an airflow through at least a first portion of the vacuum cleaner, and a main separation unit for separating dust and debris from the airflow. The first portion of the vacuum cleaner comprises the floor nozzle. The vacuum cleaner comprises a valve arranged at the nozzle end portion, the valve comprising a valve member being movable between a first position and a second position, wherein in the first position the valve member is configured to direct the airflow from the floor nozzle to the hand unit while preventing the airflow to flow through the handle end portion, and wherein in the second position the valve member is configured to direct the airflow from the floor nozzle to the handle end portion and to the hand unit.

Since the vacuum cleaner comprises a valve arranged at the nozzle end portion, the valve comprising a valve member being movable between the first and second positions, and wherein in the first position the airflow from the floor nozzle is prevented from reaching the handle end portion, and wherein in the second position the airflow from the floor nozzle is directed to the handle end portion, the floor nozzle may be utilised during vacuum cleaning both when the hand unit is connected at the nozzle end portion as well as when it is connected at the handle end portion. Thus, a user of the vacuum cleaner can use the vacuum cleaner for vacuum cleaning narrow horizontal spaces, when the hand unit is connected to the handle end portion. Moreover, the floor nozzle can be utilised when vacuum cleaning narrow horizontal spaces.

The vacuum cleaner may be configured for the user grasping the handle arranged at the handle end portion, and moving the floor nozzle over a surface to be cleaned, such as e.g. a floor surface. The vacuum cleaner may be a stick type vacuum cleaner. Accordingly, the elongated member may form a slender body of the vacuum cleaner. When vacuum cleaning, the hand unit is connected at either the nozzle end portion, or at the handle end portion. Irrespective, of whether the hand unit is connected at the nozzle end portion or at the handle end portion, the airflow flows through the first portion of the vacuum cleaner, i.e. the first portion comprising the floor nozzle.

When the hand unit is connected at the nozzle end portion, the weight of the vacuum cleaner is distributed towards the nozzle end portion. When the hand unit is connected at the handle end portion, the weight of the vacuum cleaner is distributed towards the handle end portion. That is, the centre of gravity of the vacuum cleaner is closer to the floor nozzle when the hand unit is connected at the nozzle end portion than when the hand unit is connected at the handle end portion. Thus, when vacuum cleaning larger open surfaces, the hand unit suitably is connected at the nozzle end portion in order to provide an easy handling of the vacuum cleaner. Only when vacuum cleaning narrow horizontal spaces, such as underneath furniture, the hand unit is connected at the handle end portion to permit the floor nozzle to reach into the narrow horizontal spaces. Since vacuum cleaning of narrow horizontal spaces forms only a limited part of a vacuum cleaning session, the user only has to support the added weight at the handle end portion when the hand unit is connected at the handle end portion for a limited time of the vacuum cleaning session. Also when the vacuum cleaner is stowed, the hand unit may be connected at the nozzle end portion to provide a stable unit, which may stand on the floor nozzle.

The motor fan unit is configured for producing the airflow, irrespective of whether the hand unit is connected at the nozzle end portion or at the handle end portion. The main separation unit in the hand unit is configured for separating dust and debris from the airflow, irrespective of whether the hand unit is connected at the nozzle end portion, or at the handle end portion. According to embodiments, the vacuum cleaner may comprise a first interface configured for docking the hand unit to the nozzle end portion or to the floor nozzle, and a second interface configured for docking the hand unit to the handle end portion. In this manner, the hand unit may be conveniently docked at the nozzle end portion, or alternatively at the handle end portion. The first and second interfaces may each comprise a conduit portion configured for being fluidly connected to an airflow path of the hand unit. Thus, the airflow from the floor nozzle may be directed via the respective interface to the hand unit, and the main separation unit may be arranged in the airflow path.

According to embodiments, the first interface may be mechanically linked to the valve member, wherein the valve member is positionable in the first position when the hand unit is docked to the first interface. In this manner, the airflow may be directed to the hand unit from the floor nozzle when the hand unit is connected at the nozzle end portion. The first interface may be mechanical linked to the valve member via a linkage arrangement, the linkage arrangement actuating the valve member to position it in the first position.

According to embodiments, the valve member may be biased towards the second position. In this manner, the airflow may be automatically directed towards the handle end portion when the hand unit is disconnected at the nozzle end portion, and is connected at the handle end portion.

According to embodiments, the valve member may comprise a tubular element having a first end portion and a second end portion, wherein the tubular element is pivotably connected to the elongated member at the first end portion. In this manner, the airflow may be directed through the tubular element. Moreover, the valve member may be movable between the first and second positions by the tubular element pivoting at the first end portion. The elongated member may comprise a valve portion, forming part of the valve. The valve portion may form a housing of the valve.

According to embodiments, when the valve member is in the first position, the second end portion may extend outside the elongated member for directing the airflow through the tubular element to the hand unit when the hand unit is docked to the first interface, and wherein when the valve member is in the second position, the second end portion may extend inside the elongated member for directing the airflow through the tubular element to the handle end portion and the hand unit when the hand unit is docked to the second interface. In this manner, the airflow may be directed within the vacuum cleaner depending on whether the hand unit is connected at the nozzle end portion or at the handle end portion.

According to embodiments, the second end portion of the tubular element may form part of the first interface. In this manner, the hand unit may be fluidly connected to the second end portion of the tubular element, and the airflow may be directed to the hand unit when the hand unit is docked to the first interface.

According to embodiments, the valve may comprise a flexible hose being connected to the first end portion of the tubular element, the flexible hose extending from the valve towards the floor nozzle inside the elongated member. In this manner, the flexible hose may form a seal between the tubular element and the elongated member. In particular, the flexible hose may seal against air leaking into the elongated member at the portion thereof where the first end portion of the tubular element is pivotably attached. The airflow from the floor nozzle flows through the flexible hose.

According to embodiments, the elongated member may comprise a tube extending from the nozzle end portion to the handle end portion, the tube being configured to permit the airflow to pass from the nozzle end portion to the handle end portion. In this manner, a slender body of the vacuum cleaner may be provided. Thus, the floor nozzle may reach into narrow horizontal spaces when the hand unit is connected at the handle end portion.

According to embodiments, the tube may be variable in length along a longitudinal direction, the longitudinal direction extending between the nozzle end portion and the handle end portion. In this manner, the tube may have a length which is adaptable inter alia to reach into narrow horizontal spaces, to a length of the user of the vacuum cleaner, and for storage of the vacuum cleaner. The variable length may be achieved, e.g. by the tube being telescopic, or by the tube being configured to be extend by at least one further tube element, and/or reduced in length by removal of at least one tube element.

According to embodiments, the floor nozzle may be connected to the elongated member via a pivotable connection, the pivotable connection permitting at least 70 degree pivoting of the elongated member in relation to the floor nozzle. In this manner, the elongated member may be pivoted downwardly towards a surface being cleaned while the floor nozzle remains in contact with the surface being cleaned, e.g. when the floor nozzle is moved into narrow horizontal spaces.

According to embodiments, the hand unit may comprise a control unit for controlling the motor fan unit. Thus, the vacuum cleaner may be controlled via the control unit. For instance, the vacuum cleaner may be switched on and switched off via the control unit. The control unit may further be configured for controlling an electric motor for driving a rotatable brush, and/or a light source arranged at the floor nozzle.

The vacuum cleaner may comprise a control switch arranged at the handle end portion. The control switch may be electrically connected to the control unit when the hand unit is docked to the first interface. In this manner, the vacuum cleaner may be controlled by the control switch when the hand unit is docked to the first interface. Thus, a user of the vacuum cleaner does not have to reach down to the hand unit, but may control the vacuum cleaner from the handle end portion of the vacuum cleaner.

According to embodiments, the hand unit may be useable as a separate hand held vacuum cleaner when released from the vacuum cleaner. In this manner, a multipurpose vacuum cleaner may be provided.

As mentioned above, there exists a need for providing a versatile vacuum cleaner of the stick type. It would be advantageous to adapt a stick type vacuum cleaner for enabling it for vacuum cleaning narrow horizontal spaces, such as under low furniture. To better address one or more of these concerns, a valve configured for fluidly connecting a hand held unit to an elongated member of a vacuum cleaner as defined in independent claim 21 is provided.

According to a further aspect of the disclosure there is provided a valve configured for fluidly connecting a hand unit to an elongated member of a vacuum cleaner, the valve comprising a valve member being movable between a first position and a second position, and a valve housing extending along a valve longitudinal direction. The valve member comprises a tubular element having a first end portion and a second end portion, wherein the tubular element is pivotably connected to the valve housing at the first end portion. In the first position the valve member is configured to direct an airflow from the first end portion to the second end portion at an angle to the valve longitudinal direction while preventing the airflow to flow along the valve longitudinal direction. In the second position the valve member is configured to direct the airflow along the valve longitudinal direction.

Since the valve comprises a valve member being movable between the first and second positions, since the valve member comprises the tubular element pivotably connected to the valve housing at the first end portion, since in the first position the valve member is configured to direct an airflow from the first end portion to the second end portion at an angle to the valve longitudinal direction while preventing the airflow to flow along the valve longitudinal direction, and since in the second position the valve member is configured to direct the airflow along the valve longitudinal direction, the valve when arranged in the elongated member of the vacuum cleaner directs airflow within the vacuum cleaner such that a floor nozzle of the vacuum cleaner may be utilised during vacuum cleaning both when the valve member is in the first position and in the second position. Thus, a user of the vacuum cleaner can use the vacuum cleaner for vacuum cleaning an open floor surface with a hand unit fluidly connected to the second end portion when the valve member is in the first position, and for vacuum cleaning a narrow horizontal space with the hand unit fluidly connected to the second end portion when the valve member is in the second position.

According to embodiments, when the valve member is in the first position, the second end portion extends outside the valve housing, and wherein when the valve member is in the second position, the second end portion extends inside the valve housing. In this manner, a hand unit may be fluidly connected to the second end portion when the valve member is in the first position as well as when the second end portion is in the second position.

According to embodiments, the valve may comprise a flexible hose being connected to the first end portion of the tubular element. In this manner, the flexible tube may be utilised for ensuring an airflow being directed to the first end portion of the tubular member. The flexible tube may form a seal for preventing air leakage in the valve at the first end portion of the tubular element.

According to embodiments, the valve member may be biased towards the second position. In this manner, it may be ensured that the valve member is positioned in the second position. This may be advantageous when the hand unit is arranged at a far distance from the second end portion and is to be fluidly connected to the second end portion when the valve member is in the second position.

Further features and advantages will become apparent when studying the appended claims and the following detailed description.

BRIEF DESCRIPTION OF THE DRAWINGS

Various aspects and/or embodiments, including its particular features and advantages, will be readily understood from the example embodiments discussed in the following detailed description and the accompanying drawings, in which.

DETAILED DESCRIPTION

Aspects and/or embodiments will now be described more fully. Like numbers refer to like elements throughout. Well-known functions or constructions will not necessarily be described in detail for brevity and/or clarity.

Figure 1A:
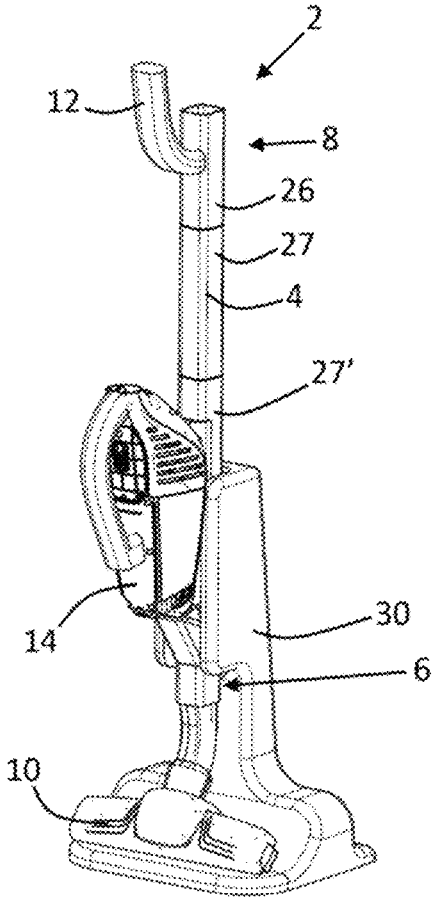
FIGS. 1*a* and 1*b* illustrate a vacuum cleaner according to first embodiments.
Figure 1B:
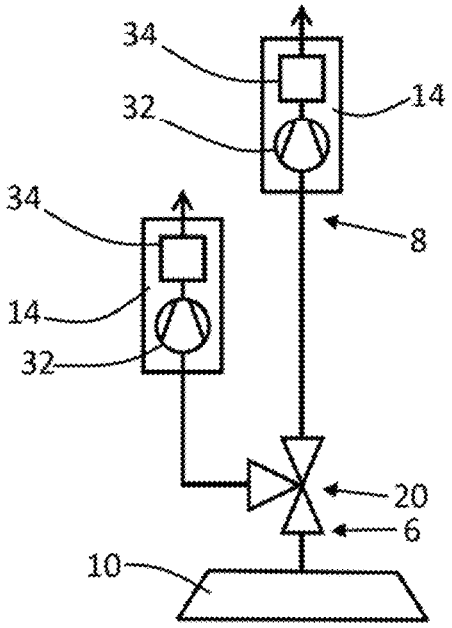
Figure 2A:
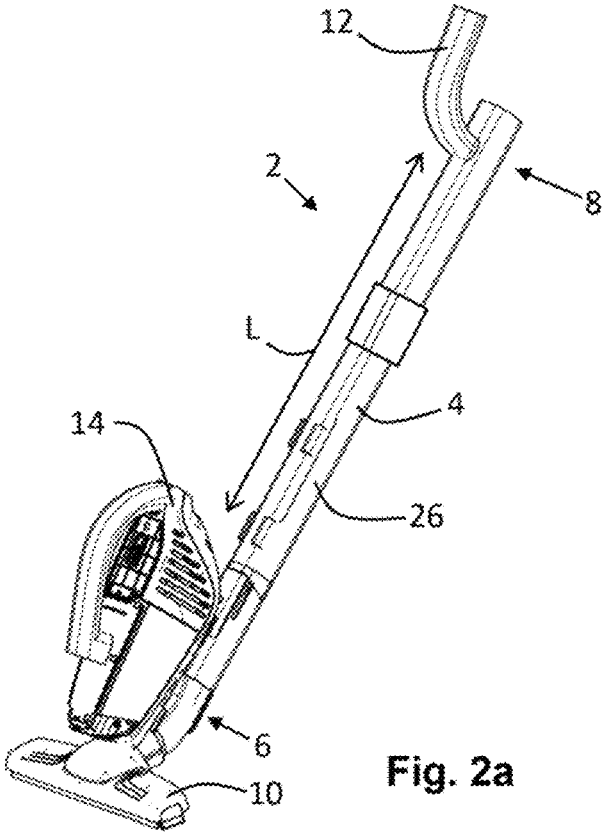
FIGS. 2*a* and 2*b* illustrate a vacuum cleaner according to second embodiments, FIGS. 3*a*-5 Illustrate embodiments of valves configured for fluidly connecting a hand unit to an elongated member of a vacuum cleaner.
Figure 2B:
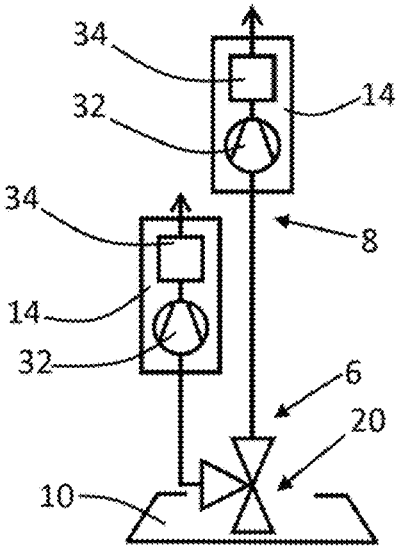

FIGS. 1*a* and 1*b* illustrate a vacuum cleaner 2 according to first embodiments. FIGS. 2*a* and 2*b* illustrate a vacuum cleaner 2 according to alternative second embodiments. In FIGS. 1*a* and 2*a* perspective views of the vacuum cleaners 2 are shown. In FIGS. 1*b* and 2*b* flow diagrams of the vacuum cleaners 2 are shown. In the following description related to FIGS. 1*a*-2*b* reference is made to both embodiments, unless specific reference is made to one particular of the embodiments. The vacuum cleaner 2 in FIG. 1*a* is shown standing in dedicated stand 30 for the vacuum cleaner 2.

The vacuum cleaner 2 comprises an elongated member 4 having a nozzle end portion 6 and a handle end portion 8. The vacuum cleaner 2 further comprises a floor nozzle 10 arranged at the nozzle end portion 6, and a handle 12 arranged at the handle end portion 8. Moreover, the vacuum cleaner 2 comprises a hand unit 14 releasably connectable at the nozzle end portion 6 and at the handle end portion 8. That is, the hand unit 14 may be connected either at the nozzle end portion 6 or at the handle end portion 8, for instance depending on what kind of vacuum cleaning operations are to be performed with the vacuum cleaner 2. In FIGS. 1*a* and 2*a* the hand unit 14 is connected at the nozzle end portion 6. In FIGS. 1*b* and 2*b* the hand unit 14 is shown connected both at the nozzle end portion 6 and at the handle end portion 8.

As is clearly shown in FIG. 1*a*, when the hand unit 14 is connected at the nozzle end portion 6 in the vacuum cleaner 2 according to the first embodiments, the hand unit 14 is connected to the elongated member 4. Similarly, as shown in FIG. 2*a*, when the hand unit 14 is connected at the nozzle end portion 6 in the vacuum cleaner 2 according to the second embodiments, the hand unit 14 is connected to the floor nozzle 10. In both embodiments, the hand unit 14 is connected at the nozzle end portion 6 of the elongated member 4. Put differently, the term "connected at the nozzle end portion" covers both connection alternatives of the hand unit, to the elongated member 6, and to the floor nozzle 10.

In a known manner, the hand unit 14 comprises a motor fan unit 32 and a main separation unit 34. The motor fan unit 32 is configured for producing an airflow through at least a portion of the vacuum cleaner 2. The main separation unit 34 is configured for separating dust and debris from the airflow. The main separation unit 34 may be removed from the hand unit 14 in order to be emptied, or replaced.

The vacuum cleaner 2 comprises a valve 20 arranged at the nozzle end portion 6. The valve 20 comprises a valve member being movable between a first position and a second position, see further with reference to FIGS. 3*a*-4*b*. When the valve member is arranged in the first position, the valve member is configured to direct the airflow from the floor nozzle 10 to the hand unit 14, when the hand unit 14 is connected at the nozzle end portion 6, as indicated by the hand unit 14 on the left in FIGS. 1*b* and 2*b*. Simultaneously, when the valve member is arranged in the first position, the valve member is configured to prevent the airflow from flowing through the handle end portion 8, when the hand unit 14 is connected at the nozzle end portion 6 of the elongated member 4. The valve member is configured to direct the airflow from the floor nozzle 10 to the handle end portion 8, when the hand unit 14 is connected at the handle end portion 8, as indicated by the hand unit 14 on the right in FIGS. 1*b* and 2*b*. Also, the valve member is configured to prevent air from leaking in through the valve 20, when the valve member is in the second position, when the hand unit 14 is connected at the handle end portion 8 of the elongated member 4.

In the embodiments of FIGS. 1*a* and 1*b*, the valve 20 is arranged in the elongated member 4. In the embodiments of FIGS. 2*a* and 2*b*, the valve 20 is arranged in the floor nozzle 10. In both embodiments, the hand unit 14 is connectable at the nozzle end portion 6 of the elongated member 4.

A flow path within the hand unit 14 is fluidly connected with the floor nozzle 10 via the valve 20 when the valve member is arranged in the first position, and the hand unit 14 is connected at the nozzle end portion 6 of the elongated member 4. Similarly, the flow path within the hand unit 14 is fluidly connected with the floor nozzle 10 via the valve 20 when the valve member is arranged in the second position, and the hand unit 14 is connected at the handle end portion 8 of the elongated member 4.

The motor fan unit 32 is configured for producing the airflow through at least a first portion of the vacuum cleaner 2 when the hand unit 14 is connected at the nozzle end portion 6 of the elongated member 4, and when the hand unit 14 is connected at the handle end portion 8 of the elongated member 4. The main separation unit 34 is configured for separating dust and debris from the airflow when the hand unit 14 is connected at the nozzle end portion of the elongated member 4, and when the hand unit 14 is connected at the nozzle end portion 8 of the elongated member 4. The first portion of the vacuum cleaner 2 comprises the floor nozzle 10.

A multipurpose vacuum cleaner 2 is provided since the hand unit 14 may be connected either at the nozzle end portion 6 of the elongated member 4, or at the handle end portion 8 of the elongated member 4. Moreover, the hand unit 14 may be useable as a separate hand held vacuum cleaner when released from the elongated member 4.

The floor nozzle 10 is fluidly connected with the nozzle end portion 6 of the elongated member 4. More specifically, a flow path inside the floor nozzle 10 is fluidly connected with a flow path in the elongated member 4. Thus, the airflow produced by the motor fan unit 32 in the hand unit 14 flows from the floor nozzle 10 to the nozzle end portion 6, at least when the valve member is in the second position and the hand unit 14 is connected at the handle end portion 8. In the first embodiments, illustrated in FIGS. 1*a* and 1*b*, the flow path inside the floor nozzle 10 is fluidly connected with a flow path in the first end portion 6 of the elongated member 4, when the hand unit 14 is connected at the nozzle end portion 6. The airflow produced by the motor fan unit 32 in the hand unit 14 flows from the floor nozzle 10 to the nozzle end portion 6, when the valve member is in the first position and the hand unit 14 is arranged at the nozzle end portion 6.

The elongated member 4 comprise a tube 26 extending from the nozzle end portion 6 to the handle end portion 8. The tube 26 is configured to permit the airflow to pass from the nozzle end portion 6 to the handle end portion 8. That is, the tube 26 forms a flow path of the elongated member 4 for the airflow produced by the motor fan unit 32 in the hand unit 14. The tube 26 may form the main part of the elongated member 4. The tube 26 may form the elongated member 4. The floor nozzle 10 may be connected to the tube 26. The handle 12 may be connected to the tube 26.

The elongated member 4 may form a slender body of the vacuum cleaner 2. The tube 26 may form the slender body of the vacuum cleaner 2. Thus, the floor nozzle may reach into narrow horizontal spaces when the hand unit 14 is connected at the handle end portion 8.

The tube 26 may be variable in length along a longitudinal direction L. The longitudinal direction L extends between the nozzle end portion 6 and the handle end portion 8, as indicated in FIG. 2*a*. Thus, the tube 26 may have a length which is adaptable for different situations during vacuum cleaning and stowing of the vacuum cleaner 2. The variable length may be achieved by the tube 26 being telescopic, as in the embodiments of FIG. 2*a*, wherein the portion of the tube 26 comprising the handle end portion 8 may be moved along the longitudinal direction L into the portion of the tube 26 comprising the nozzle end portion 6 and in the opposite direction.

Alternatively, tube 26 may be variable in length along a longitudinal direction L by the tube 26 being configured to be extend by at least one tube element 27, and/or reduced in length by removal of at least one tube element 27. Accordingly, the tube 26 may comprise two or more tube elements 27, 27', as shown in FIG. 1*a*.

Figure 3A:
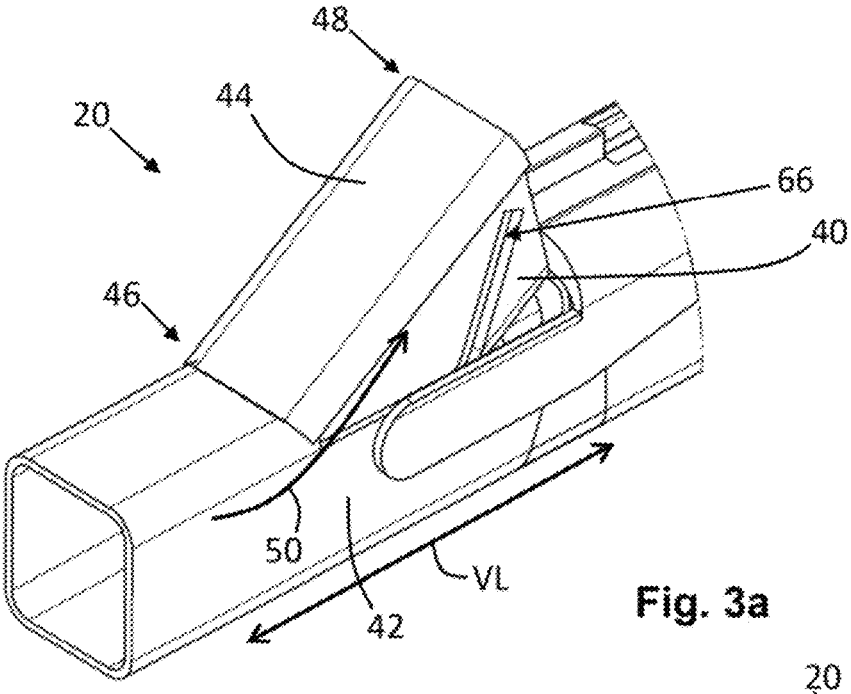
Figure 3B:
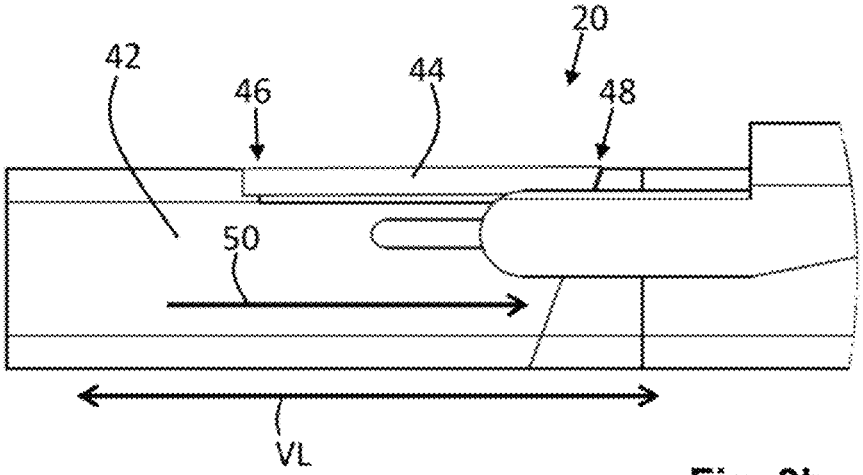
Figure 3C:
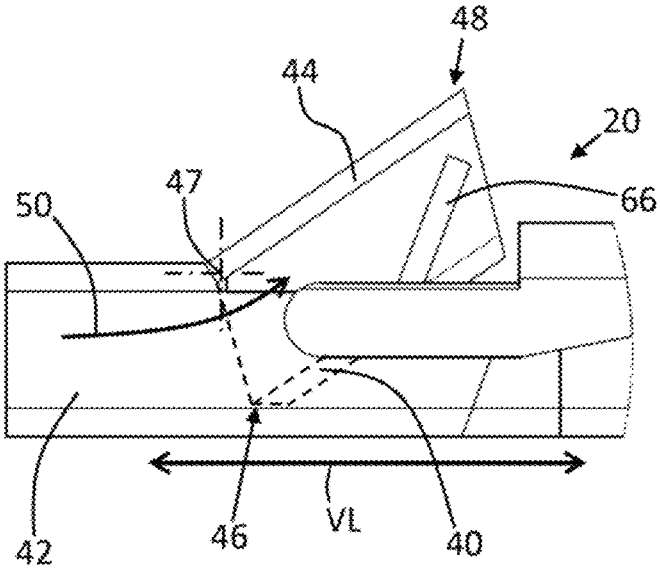
Figure 4A:
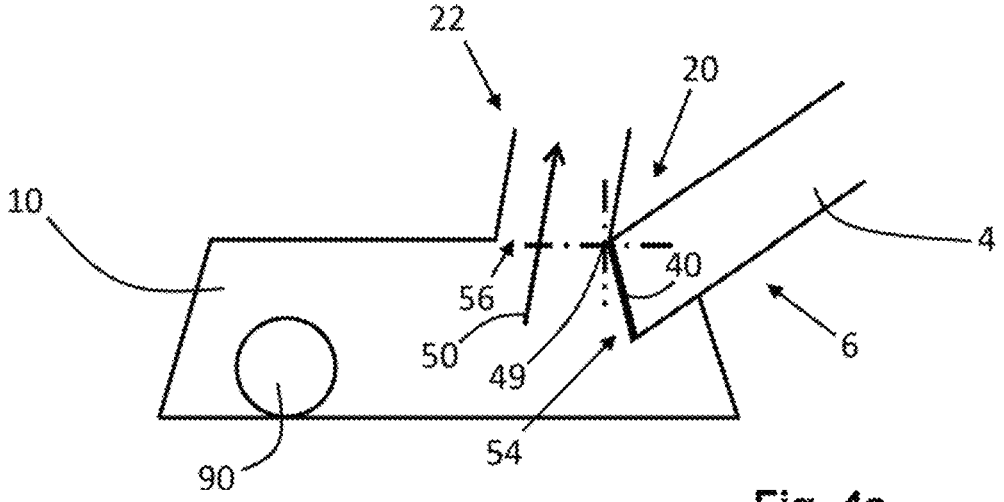
Figure 4B:
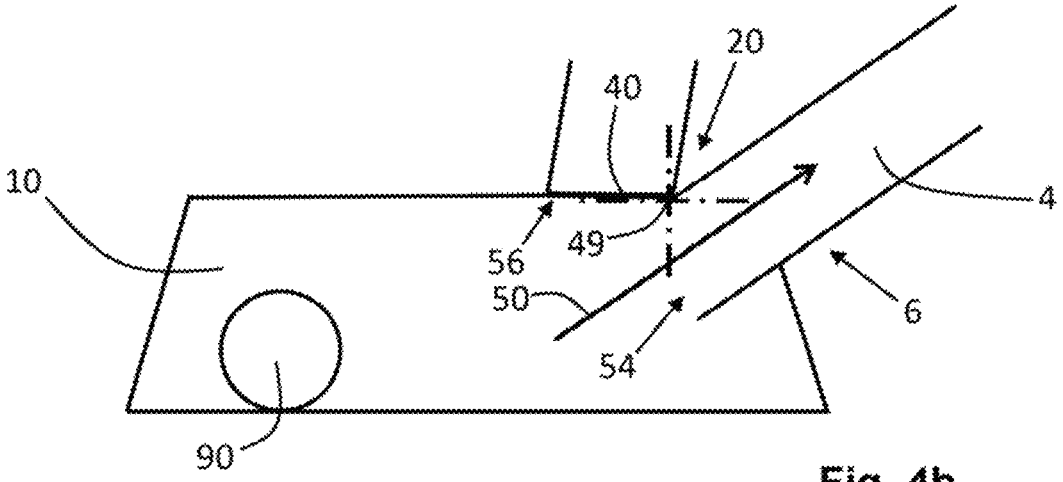
Figure 5:
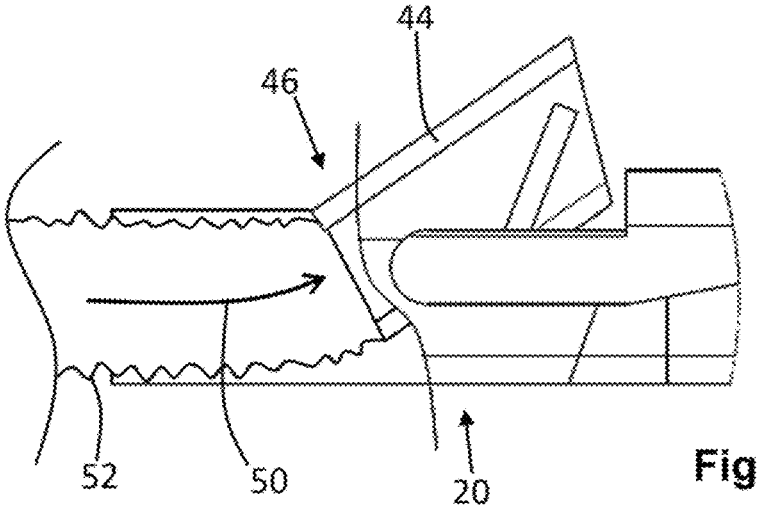

FIGS. 3*a*-5 Illustrate embodiments of valves 20 configured for fluidly connecting a hand unit 14 to an elongated member 4 of a vacuum cleaner 2. FIGS. 3*a*-3*c* show embodiments of a valve 20 configured for being utilised in a vacuum cleaner 2 of the first embodiments discussed above with reference to FIGS. 1*a* and 1 *b*. FIGS. 3*a* and 3*b* show a perspective view and a side view of the valve 20. FIG. 3*c* shows a side view of the valve 20 with broken lines indicating parts thereof. FIGS. 4*a* and 4*b* show embodiments of a valve 20 configured for being utilised in a vacuum cleaner 2 of the second embodiments discussed above with reference to FIGS. 2*a* and 2*b*. FIG. 5 shows a partial cross section through alternative embodiments of a valve 20 configured for being utilised in a vacuum cleaner 2 of the first embodiments discussed above with reference to FIGS. 1*a* and 1 *b*.

Referring to FIGS. 3*a*-3*c*, the valve 20 comprises a valve member 40 and a valve housing 42. The valve housing 42 extends along a valve longitudinal direction VL. The valve member 40 comprises a tubular element 44 having a first end portion 46 and a second end portion 48. The tubular element 44 is pivotably connected to the valve housing 42 at the first end portion 46. The tubular element 44 may pivot about a pivot axis 47 at the first end portion 46 indicated in FIG. 3*c*.

The valve member 40 is movable between a first position, shown in FIGS. 3*a* and 3*c*, and a second position, shown in FIG. 3*b*. An airflow 50 through the valve 20 is indicated with arrows 50 in FIGS. 3*a*-3*c*. In the first position the valve member 40 is configured to direct the airflow 50 from the first end portion 46 of the tubular element 44 to the second end portion 48 of the tubular element 44, at an angle to the valve longitudinal direction VL, while preventing the airflow 50 to flow along the valve longitudinal direction VL. In the second position the valve member 40 is configured to direct the airflow 50 from the first end portion 46 of the tubular element 44 to the second end portion 48 of the tubular element 44, along the valve longitudinal direction VL. In the second position the valve member 40 is configured to prevent the airflow 50 from flowing at an angle to the valve longitudinal direction VL.

When the valve member 40 is in the first position, the second end portion 48 extends outside the valve housing 42. When the valve member 40 is in the second position, the second end portion 48 extends inside the valve housing 42.

The valve housing 42 may form part of, or may be connected to, the elongated member 4 of a vacuum cleaner 2 according to the first embodiments discussed above with reference to FIGS. 1*a* and 1*b*. The valve housing 42 may form part of, or may be connected to, the tube 26 of a vacuum cleaner 2 according to the first embodiments discussed above with reference to FIGS. 1*a* and 1*b*.

Accordingly, the first end portion 46 of the tubular element 44 may be arranged closer to the floor nozzle 10 of the vacuum cleaner 2 than the second end portion 48 of the tubular element 44.

The valve 20 thus, is configured for directing the airflow 50 to two different parts of a vacuum cleaner. For instance, in a vacuum cleaner 2 according to the first embodiments discussed above with reference to FIGS. 1*a* and 1*b*, the airflow from the floor nozzle 10 may directed either to the hand unit 14 when it is connected at the nozzle end portion 6 of the elongated member 4, or to the hand unit 14 when it is connected at the hand end 8 of the elongated member 4.

According to some embodiments, the valve member 40 may be biased towards the second position, shown in FIG. 3*b*. Thus, the valve member 40 will be automatically moved into the second position for the second end portion 48 to extends inside the valve housing 42.

The tubular element 44 may comprise at least one track 66. The at least one track 66 is curved. A protrusion may extend into the at least one track 66 for running along the at least one track 66. Thus, by running the protrusion along the at least one track 66, the tubular element 44 may be pivoted about the pivot axis 47, see below with reference to FIGS. 6*a* and 6*b*.

The valve 20 according to the embodiments of FIG. 5 resembles in much the embodiments of FIGS. 3*a*-3*c*. The main difference is that the valve 20 of the FIG. 5 embodiments comprises a flexible hose 52 being connected to the first end portion 46 of the tubular element 40. The flexible hose 52 extends from the first end portion 46 towards a floor nozzle of a relevant vacuum cleaner. The flexible hose 52 forms at least part of a flow path for the airflow 50 from the floor nozzle to the valve 20. The flexible hose 52 may form a seal for preventing air leakage at the first end portion 46 of the tubular element 40 of the valve 20.

In the embodiments of FIGS. 4*a* and 4*b*, the valve 20 is arranged in the floor nozzle 10 and comprises a valve member 40 arranged in the floor nozzle 10. The valve member 40 is pivotably connected in the floor nozzle 10. The valve member 40 may pivot about a pivot axis 49. The valve member 40 is movable between a first position, shown in FIG. 4*a*, and a second position, shown in FIG. 4*b*.

In the first position, the valve member 40 closes a first opening 54 of the valve 20, which first opening 54 is fluidly connected with the elongated member 4, more specifically with the nozzle end portion 6 of the elongated member 4. Thus, when the valve member 40 is in the first position, an airflow to the elongated member 4 is prevented. A second opening 56 of the valve 20 is open when the valve member 40 is in the first position. Thus, an airflow 50 through the floor nozzle 10 and the valve 20, indicated with arrow 50 in FIG. 4*a*, is directed to a first interface 22 for connecting thereto the hand unit (not shown). The first interface 22 is arranged on, or connects to, the floor nozzle 10. That is, when the hand unit is connected to the first interface 22, the hand unit is connected at the nozzle end portion 6 of the elongated member 4. The first interface 22 is configured for docking the hand unit 14 to the floor nozzle 10.

In the second position, the valve member 40 closes the second opening 56 preventing an airflow to the first interface 22. In the second position of the valve member 40, the first opening 54 is open, and permits an airflow 50 through the floor nozzle 10 and the valve 20 to flow to the elongated member 4. The airflow 50 is indicated with arrow 50 in FIG. 4*b*. When the hand unit is connected at the handle end portion (not shown) of the elongated member 4, the airflow 50 through the first opening 54 is produced by the hand unit.

Again, the valve member 40 may be biased towards the second position, shown in FIG. 4*b*. Thus, the valve member 40 will be automatically moved into the second position for closing the second opening 56 and directing the airflow 50 to the elongated member 4. The valve member 40 may be biased into the second position by a non-shown spring, such as a torsion spring. When the hand unit is docked to the first interface 22, the valve member 40 may be automatically moved into the first position, e.g. by a non-shown mechanism.

In the embodiments of FIGS. 4*a* and 4*b*, the floor nozzle 10 comprise a rotatable brush 90, see further below with reference to FIG. 8.

Figure 6C:
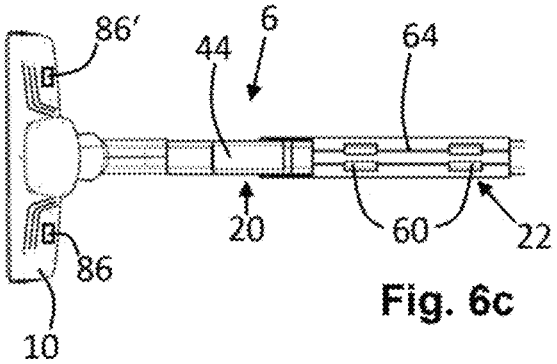
FIGS. 6*a*-6*c* illustrate a vacuum cleaner according to embodiments.
Figure 6A:
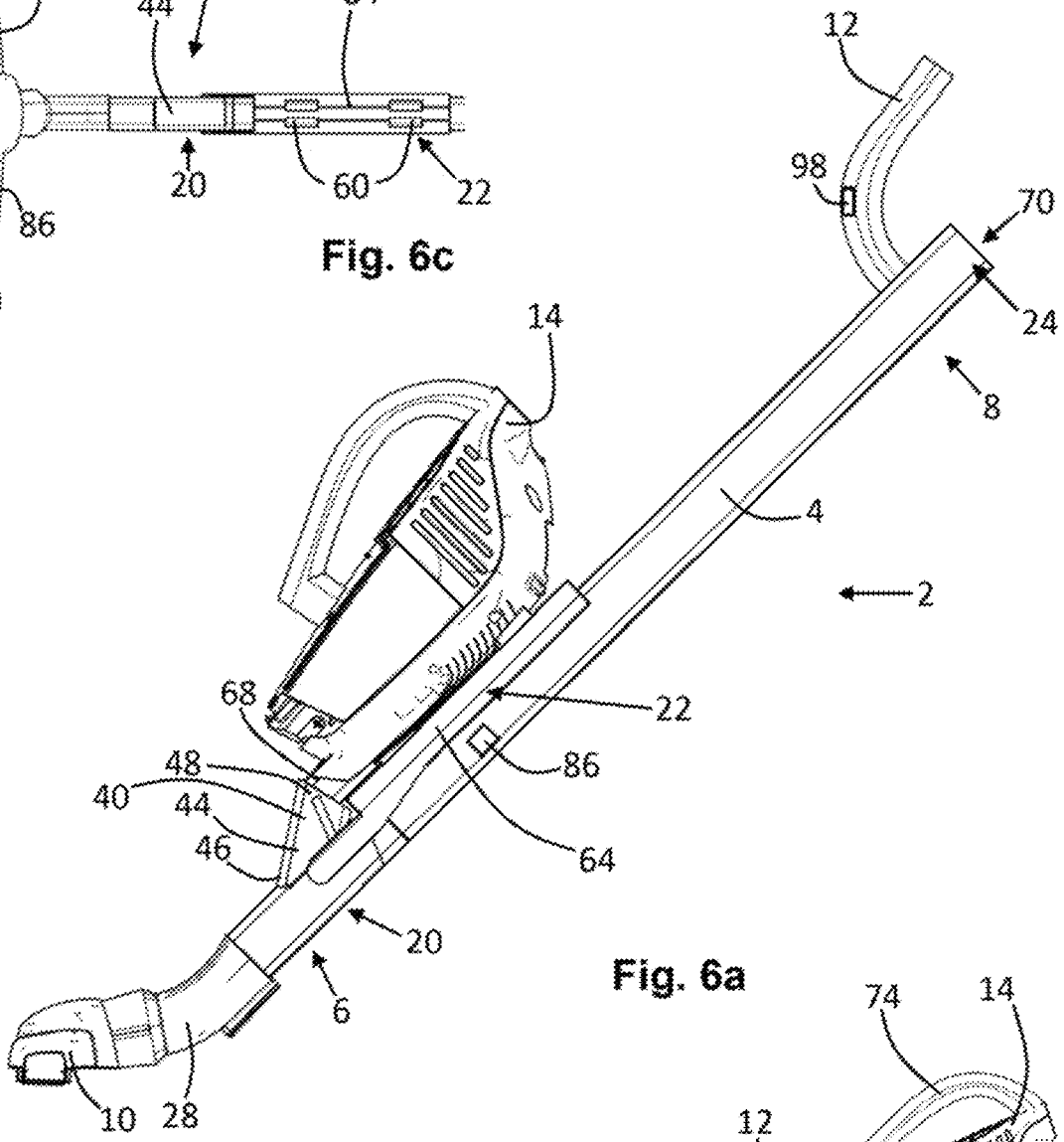
Figure 6B:
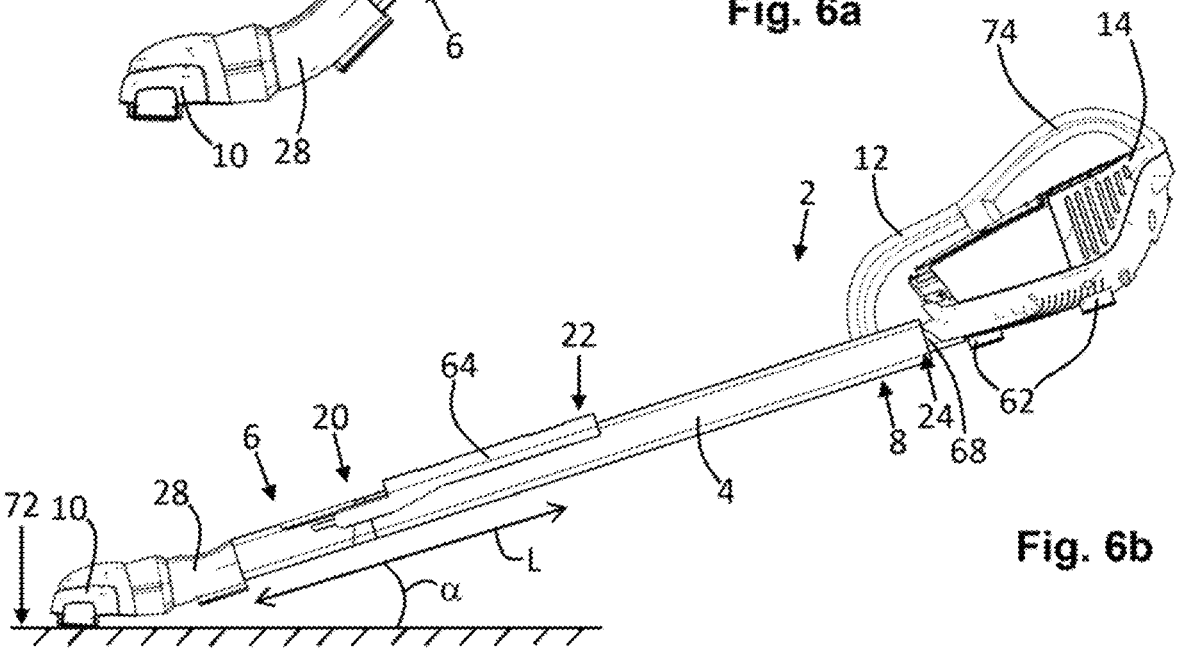

FIGS. 6*a*-6*c* illustrate a vacuum cleaner 2 according to embodiments. The vacuum cleaner 2 is a vacuum cleaner according to the first embodiments discussed in connection with FIGS. 1*a* and 1*b*. In FIG. 6*a* the hand unit 14 is docked to the nozzle end portion 6 of the elongated member 4. In FIG. 6*b* the hand unit 14 is docked to the handle end portion 8 of the elongated member 4. In FIG. 6*c* the floor nozzle 10 and a portion of the nozzle end portion 6 of the vacuum cleaner 2 are shown.

The vacuum cleaner 2 comprises a first interface 22 configured for docking the hand unit 14 to the nozzle end portion 6 of the elongated member 4, and a second interface 24 configured for docking the hand unit 14 to the handle end portion 8 of the elongated member 4.

In these embodiments, the first interface 22 comprises one or more recesses 60 configured for receiving and engaging with protrusions 62 arranged at an outer surface of the hand unit 14. The recesses 60 are provided in a connection member 64. When the hand unit 14 is connected to the first interface 22, the valve member of the valve 20 is arranged in the first position, as discussed above with reference to FIGS. 1*a* and 1*b*, and 3*a*-3*c*. Thus, an airflow produced in the hand unit 14 is directed from the floor nozzle 10 via the valve 20 to the hand unit 14, and an airflow to, or from, the handle end portion 8 is prevented.

The first interface 22 is mechanically linked to the valve member 40. Thus, the valve member 40 is positionable in the first position when the hand unit 14 is docked to the first interface 22. More specifically, in these embodiments the connection member 64 is movable along the elongated member 4 along the longitudinal direction L. When the hand unit 14 is being connected to the first interface 22, the connection member 64 is moved from a rearward position shown in FIGS. 6*b* and 6*c* to a forward position towards the floor nozzle 10, shown in FIG. 6*a*. The connection member 64 is mechanically linked to the valve member 40 via a protrusion (not shown) configured to run along a track 66 of the tubular element 44, see FIGS. 3*a* and 3*c*, such that the valve member 40 is pivoted about the first end portion 46 as the connection member 64 is moved from the rearward to the forward position. Thus, the second end portion 48 of the tubular element 44 may be fluidly connected to a mouthpiece 68 of the hand unit 14, see also FIG. 7*a*. The second end portion 48 of the tubular element 44 may form part of the first interface 22.

In these embodiments, a rear end of the handle end portion 8 comprises the second interface 24. The second interface 24 is formed by an opening 70 in the rear end of the handle end portion 8. The mouthpiece 68 of the hand unit 14 fits into the opening 70. Thus, an airflow produced in the hand unit 14 is directed from the floor nozzle 10 through the entire elongated member 4 to the hand unit 14. The valve member 40 of valve 20 is in the second position. Accordingly, the airflow is directed via the valve 20 from the nozzle end portion 6 to the handle end portion 8. An airflow into the elongated member 4 at the valve 20 is prevented.

The valve member 40 is positionable in the second position when the hand unit 14 is docked to the second interface 24. In this manner, the airflow from the floor nozzle 10 is directed towards the handle end portion 8 and the hand unit 14.

As mentioned above, the valve member 40 may be biased towards the second position. For instance, the connection member 64 may be spring loaded towards its rearward position. Thus, when the hand unit 14 is not connected to the first interface 22, the mechanical link between the valve member 40 and the connection member 64 will pivot the valve member into the second position as the connection member 64 is pulled, or pushed, towards its rearward position.

When the valve member 40 is in the first position, the second end portion 48 extends outside the elongated member 4. That is, the tubular element 44 points at an angle to the longitudinal direction L. Thus, the airflow is directed through the tubular element 44 to the hand unit 14 when the hand unit 14 is docked to the first interface 22, as shown in FIG. 6*a*. When the valve member 40 is in the second position, the second end portion 48 may extend inside the elongated member 4. That is, the tubular element 44 extends along the longitudinal direction L. Thus, the airflow is directed through the tubular element 44 to the handle end portion 8 and the hand unit 14 when the hand unit 14 is docked to the second interface 24, as shown in FIG. 6*b*.

The floor nozzle 10 is connected to the elongated member 4 via a pivotable connection 28. Thus, the floor nozzle 10 may be pivoted in relation to the elongated member 4. The pivotable connection 28 may permit at least 70 degree pivoting of the elongated member 4 in relation to the floor nozzle 10. Put differently, an angle $\alpha$ between a floor surface 72, which is being vacuum cleaned, and the longitudinal direction L of the elongated member 4 may be varied over at least 70 degrees, while the floor nozzle 10 abuts in a vacuum cleaning position against the floor surface 72.

When the hand unit 14 is docked to the first interface 22, as shown in FIG. 6*a*, a centre of gravity of the vacuum cleaner 2 is closer to the floor nozzle 10 than when the hand unit 14 is docked to the second interface 24, as shown in FIG. 6*b*. Thus, when vacuum cleaning open surfaces, the hand unit 14 may suitably be docked to the first interface 22. The user of the vacuum cleaner 2 grasps the vacuum cleaner 2 by the handle 12, and moves the floor nozzle 10 along the surface to be cleaned. Due to the centre of gravity being shifted towards the floor nozzle 10, the user has to support a lesser portion of the weight of the vacuum cleaner 2. When vacuum cleaning narrow horizontal spaces, such as underneath furniture, the hand unit 14 docked to the first interface 22 may prevent the floor nozzle 10 from reaching into an entire narrow horizontal space. Thus, the hand unit 14 may be docked to the second interface 24. Thus, the floor nozzle 10 may reach the entire narrow horizontal space. The elongated member 4 forms an extension between the floor nozzle 10 and the mouthpiece 68 of the hand unit 14. The user, still grasping the handle at 12 or a handle 74 of the hand unit 14 may direct the floor nozzle 10 into the narrow horizontal space. The pivotable connection 28 may ensure that the floor nozzle 10 abuts against the surface being vacuum cleaner within the narrow horizontal space. During vacuum cleaning of narrow horizontal spaces, when the hand unit 14 is docked to the second interface 24, the user has to support a larger portion of the weight of the vacuum cleaner 2.

In FIGS. 6*a* and 6*b* electrical connectors 86, 86' at the elongated member 4 and at the floor nozzle 10 are shown, see further below with reference to FIG. 8. A control switch 98 is indicated in FIG. 6*a*, see further below with reference to FIG. 8.

Figure 7A:
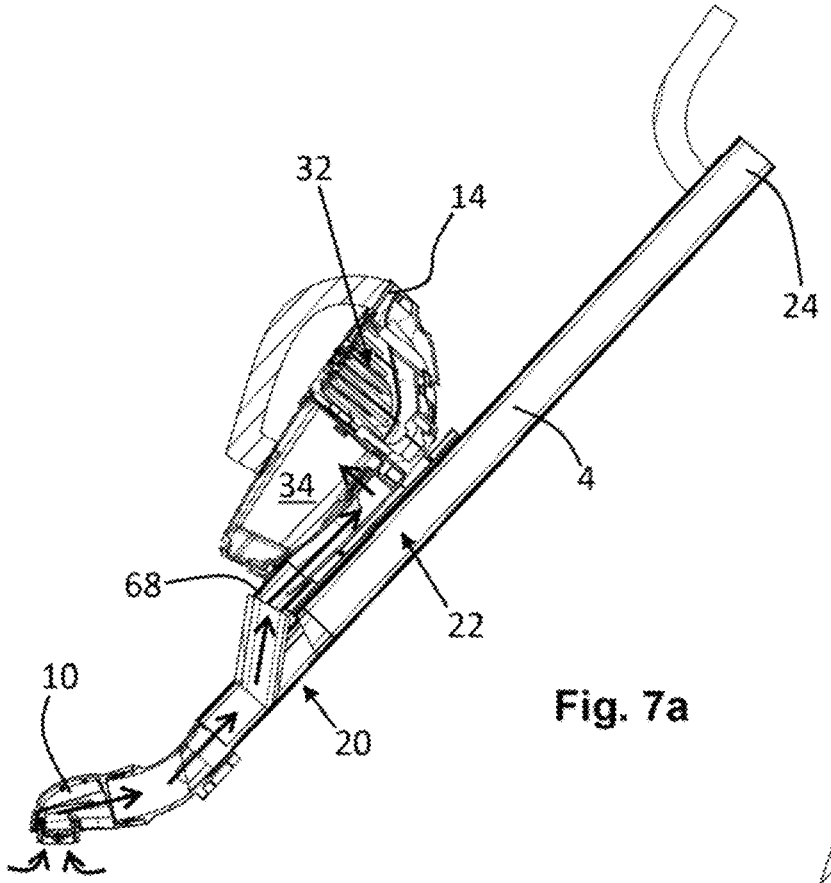
FIGS. 7*a* and 7*b* illustrate cross sections through a vacuum cleaner.
Figure 7B:
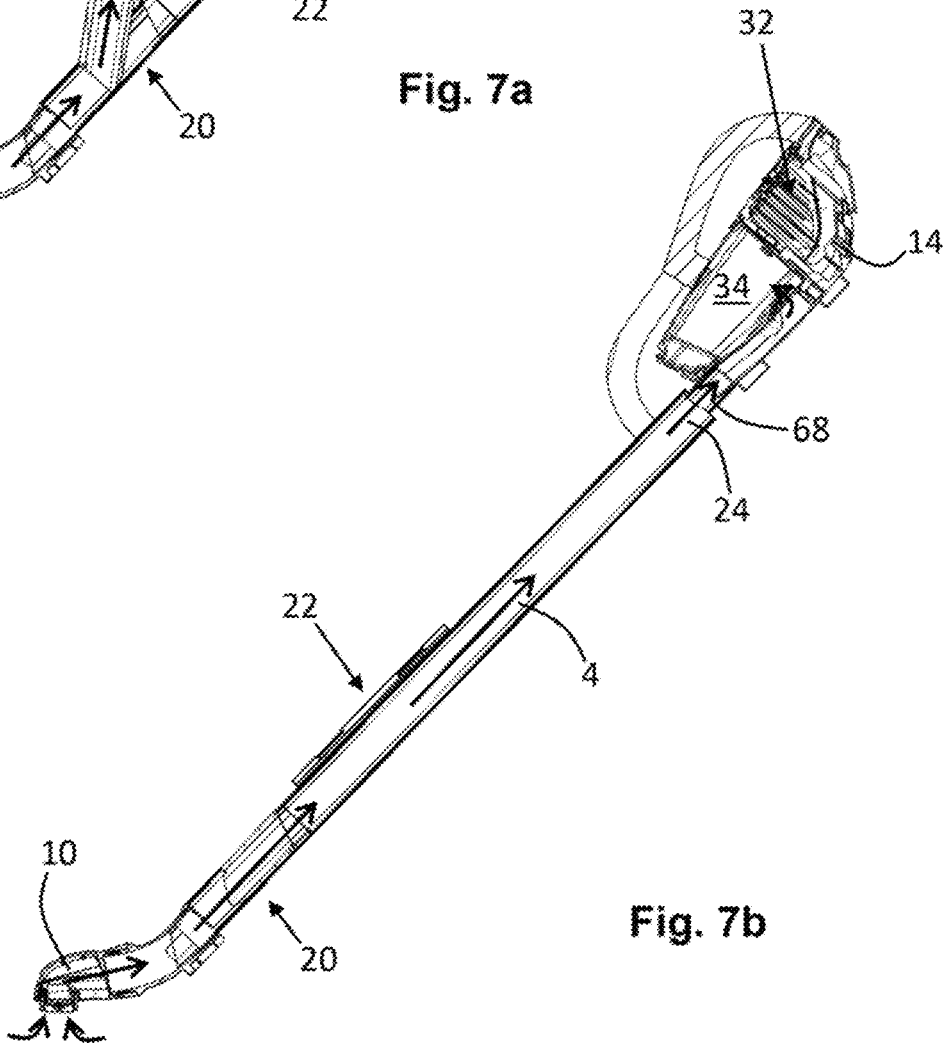

FIGS. 7*a* and 7*b* illustrate cross sections through the vacuum cleaner 2 of the first embodiments of FIGS. 1*a*, 1*b*, 6*a*-6*c*. The airflow through the vacuum cleaner 2 when the hand unit 14 is docked to the first interface 22, and to the second interface 24, respectively, will now be described. The airflow through the vacuum cleaner 2 is indicated with arrows in FIGS. 7*a* and 7*b*.

The motor fan unit 32 of the hand unit 14 produces an airflow through at least a first portion of the vacuum cleaner 2. In the main separation unit 34 of the hand unit 14 dust and debris is separated from the airflow. In a known manner, the main separation unit 34 may comprise a cyclone for separating the dust and debris from the airflow. Alternatively, the main separation unit 34 may comprise an air permeable disposable receptacle for separating the dust and debris from the airflow.

An airflow path of the hand unit 14 extends from the mouthpiece 68 in to the main separation unit 34, through the motor fan unit 32, and to an air outlet (not shown).

When the hand unit 14 is docked to the first interface 22, as shown in FIG. 7*a*, the airflow flows through the first portion of the vacuum cleaner 2 comprising the floor nozzle 10, to the elongated member 4, through the valve 20, and through the airflow path of the hand unit 14. Airflow through the elongated member 4 between the valve 20 and the second interface 24 is prevented by the valve 20. The valve member of the valve 20 is arranged in the first position.

When the hand unit 14 is docked to the second interface 24, as shown in FIG. 7*b*, the airflow flows through the first portion of the vacuum cleaner 2 comprising the floor nozzle 10, through the entire elongated member 4, and through the airflow path of the hand unit 14. The valve member of the valve 20 is arranged in the second position.

Figure 8:
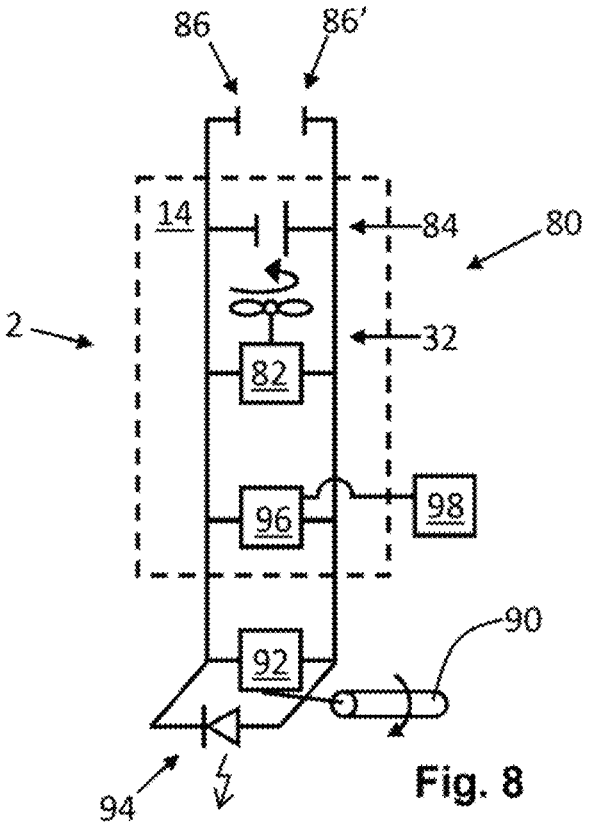
FIG. 8 illustrates embodiments of an electric circuitry of a vacuum cleaner.

FIG. 8 schematically illustrates embodiments of an electric circuitry 80 of a vacuum cleaner 2 according to aspects and/or embodiments discussed herein. The motor fan unit 32 of the vacuum cleaner 2 comprise an electric motor 82. The vacuum cleaner 2 comprises a rechargeable battery 84 arranged in the hand unit 14. The rechargeable battery 84 is configured for supplying electric power to the motor fan unit 32. More specifically, the rechargeable battery 84 is connected to the electric motor 82 of the motor fan unit 32. The hand unit 14 is indicated with broken lines in FIG. 8.

Figure 9:
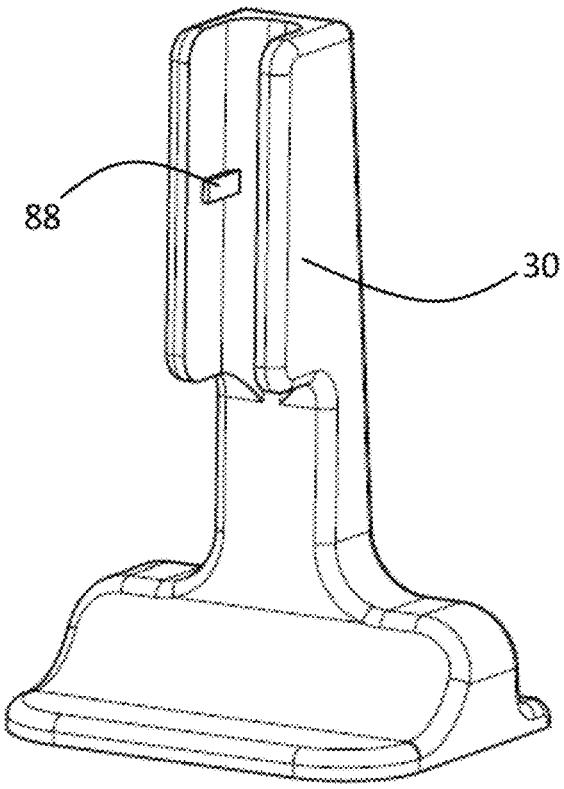
FIG. 9 illustrates example embodiments of a stand for a vacuum cleaner.

The vacuum cleaner 2 comprises at least two electrical connectors 86, 86' arranged at the elongated member or at the floor nozzle, and being configured for receiving a charging current. The vacuum cleaner 2 further comprises electrical conductors extending between the at least two electrical connectors 86, 86' and the rechargeable battery 84 arranged in the hand unit 14. Thus, a charging current may be provided to the rechargeable battery 84. In FIG. 6*a* one of the at last two electrical connectors 86 is indicated at the elongated member 4. In FIG. 6*c* two of the at last two electrical connectors 86, 86' are indicated at the floor nozzle 10. FIG. 9 illustrates example embodiments of a stand 30 for the vacuum cleaner 2. Inside the stand 30 a battery charger may be arranged. Via contact plates 88, one of which is shown in FIG. 9, charging current may be conducted to the at least two electrical connectors 86, 86' of the vacuum cleaner 2 when the vacuum cleaner 2 is standing in the stand 30 as shown in FIG. 1*a*.

Returning to FIG. 8, the floor nozzle may comprise a rotatable brush 90. In this manner, the rotatable brush 90 may brush dust and debris from a surface being vacuum cleaned thus, assisting entrainment of the dust and debris with the airflow entering the floor nozzle. In FIGS. 4*a* and 4*b* the rotatable brush 90 is shown. Suitably, the floor nozzle may comprise an electric motor 92 configured for driving the rotatable brush 90.

The electric motor 92 configured for driving the rotatable brush 90 is electrically connected to a rechargeable battery. The electric motor 92 configured for driving the rotatable brush 90 may be connected to the rechargeable battery 84 arranged in the hand unit 14, as shown in FIG. 8. Alternatively, there may be provided a separate rechargeable battery at the floor nozzle for providing electric current to the electric motor 92 configured for driving the rotatable brush 90.

The floor nozzle may comprise a light source 94, such as e.g. an LED. Thus, a surface being vacuum cleaned may be lit up. For instance, in narrow horizontal spaces, the light source 94 may ensure that the user of the vacuum cleaner may see dust and debris.

The vacuum cleaner may comprise a control unit 96 for controlling at least the motor fan unit 32. More specifically, the control unit 96 may be configured for controlling the electric motor 82 of the motor fan unit 32. Such control may comprise switching on and off the electric motor 82, and may optionally comprise a speed control of the electric motor 82. Via the control unit 96 also other components of the vacuum cleaner may be controlled, such as the electric motor 92 configured for driving the rotatable brush 90, the light source 94, and even charging of the rechargeable battery 84, just to mention a few examples.

The hand unit 14 may comprise a control unit 96 for controlling the motor fan unit 32, and wherein the control unit 96 is further configured for controlling the electric motor 92 for driving the rotatable brush 90, and/or the light source 94 arranged at the floor nozzle In its simplest form, the control unit 96 may comprise one or more electrical switches. However, the control unit 96 may comprises a calculation unit which may take the form of substantially any suitable type of processor circuit or microcomputer. The control unit 96 may comprises a memory unit. The calculation unit may be connected to the memory unit, which provides the calculation unit with, for example, stored programme code and/or stored data which the calculation unit needs to enable it to do calculations. The calculation unit may also be adapted to storing partial or final results of calculations in the memory unit, e.g. calculations related to the control of the electric motor is 82, 92, the charging of the rechargeable battery 84, etc.

According to embodiments, the hand unit 14 may comprise a control unit 96 for controlling the motor fan unit 32. The vacuum cleaner 2 may comprise a control switch 98 arranged at the handle end portion of the elongated member. The control switch 98 may be electrically connected to the control unit 96 when the hand unit 14 is docked to the first interface. Thus, a user of the vacuum cleaner 2 may control the vacuum cleaner 2 from the handle end portion of the vacuum cleaner 2, and does not have to reach down to the hand unit for controlling the vacuum cleaner 2 when the vacuum cleaner 2 is docked to the first interface. Via the control switch 98, at least the motor fan unit 32 may be controlled. Additionally, electric motor 92 configured for driving the rotatable brush 90, and/or the light source 94 may be controlled via the control switch 98. The control switch 98 is also indicated in FIG. 6*a*.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the invention, as defined by the appended claims.

The invention claimed is:

1. A vacuum cleaner comprising:

an elongated member comprising a tube having a nozzle end portion and a handle end portion, a floor nozzle arranged at the nozzle end portion, a handle arranged at the handle end portion, and a hand unit releasably and selectively connectable at the nozzle end portion and at the handle end portion, wherein the hand unit comprises an air inlet mouthpiece, a main separating unit, and a motor fan unit configured to produce an airflow through the air inlet mouthpiece and to the main separation unit for separating dust and debris from the airflow, a valve arranged at the nozzle end portion, the valve comprising a valve member having a first end portion and a second end portion, the valve member being movable between a first position in which the second end portion extends outside the elongated member to direct the airflow from the floor nozzle to the hand unit while preventing the airflow to flow through the handle end portion, and a second position in which the second end portion extends inside the elongated member to direct the airflow from the floor nozzle to the handle end portion and to the hand unit; and a first interface configured for docking the hand unit to the elongated member at the nozzle end portion, and a second interface configured for docking the hand unit to the elongated member at the handle end portion;

wherein the first interface comprises a connection member configured such that upon coupling the hand unit to the first interface, the connection member is caused to move relative to the elongated member to move the valve member from the second position to the first position.

2. The vacuum cleaner according to claim 1, wherein the valve member is biased towards the second position.

3. The vacuum cleaner according to claim 1, wherein the valve member comprises a rigid tubular element having a first end portion and a second end portion, wherein the tubular element is pivotably connected to the elongated member at the first end portion, and wherein when the valve member is in the first position, the second end portion extends outside the elongated member for directing the airflow through the tubular element to the air inlet mouthpiece when the hand unit is docked to the first interface, and wherein when the valve member is in the second position, the second end portion extends inside the elongated member for directing the airflow through the tubular element to the handle end portion and the air inlet mouthpiece when the hand unit is docked to the second interface.

4. The vacuum cleaner according to claim 3, wherein the second end portion of the tubular element forms part of the first interface.

5. The vacuum cleaner according to claim 3, wherein the valve comprises a flexible hose connected to the first end portion of the tubular element, the flexible hose extending from the valve towards the floor nozzle inside the elongated member.

6. The vacuum cleaner according to claim 1, wherein the tube is variable in length along a longitudinal direction, the longitudinal direction extending between the nozzle end portion and the handle end portion.

7. The vacuum cleaner according to claim 1, wherein the floor nozzle is connected to the elongated member via a pivotable connection, the pivotable connection permitting at least 70 degree pivoting of the elongated member in relation to the floor nozzle.

8. The vacuum cleaner according to claim 1, wherein the floor nozzle comprises a rotatable brush.

9. The vacuum cleaner according to claim 8, wherein the floor nozzle comprises an electric motor configured for driving the rotatable brush.

10. The vacuum cleaner according to claim 9, wherein the electric motor configured for driving the rotatable brush is electrically connected to a rechargeable battery.

11. The vacuum cleaner according to claim 9, wherein the hand unit comprises a control unit for controlling the motor fan unit, and wherein the control unit is further configured for controlling the electric motor for driving the rotatable brush, and/or a light source arranged at the floor nozzle.

12. The vacuum cleaner according to claim 1, wherein the hand unit comprises a control unit for controlling the motor fan unit, wherein the vacuum cleaner comprises a control switch arranged at the handle end portion, and wherein the control switch is electrically connected to the control unit when the hand unit is docked to the first interface.

13. The vacuum cleaner according to claim 1, further comprising a rechargeable battery arranged in the hand unit, wherein the rechargeable battery is configured for supplying electric power to the motor fan unit.

14. The vacuum cleaner according to claim 13, further comprising at least two electrical connectors arranged at the elongated member or at the floor nozzle being configured for receiving a charging current, and electrical conductors extending between the at least two electrical connectors and the rechargeable battery arranged in the hand unit.

15. The vacuum cleaner according to claim 1, wherein the hand unit is useable as a separate handheld vacuum cleaner when released from the vacuum cleaner.

16. The vacuum cleaner according to claim 1, wherein the valve member comprises a tubular element having a side surface and a track extending along the side surface, and the connection member is configured to contact the track to move the valve member from the second position to the first position.

17. A valve assembly configured for fluidly connecting a hand unit to an elongated member of a vacuum cleaner, the valve assembly comprising:

an elongated member having a nozzle end portion and a handle end portion;

a valve housing extending along a valve longitudinal direction and attached to the elongated member at the nozzle end portion;

a valve member comprising a tubular element having a first end portion and a second end portion, wherein the tubular element is pivotably connected to the valve housing at the first end portion; and a first interface configured for docking a hand unit, the first interface comprising a connection member configured to move relative to the elongated member to move the valve between:

a first position in which the second end portion is located outside the elongated member and the valve member is configured to direct an airflow from the nozzle end portion to the first end portion and then to the second end portion at an angle to the valve longitudinal direction while preventing the airflow to flow along the valve longitudinal direction to the handle end portion, and a second position in which the second end portion is located inside the elongated member and configured to direct the airflow along the valve longitudinal direction from the nozzle end portion to the first end portion, and then to the second end portion, and then to the handle end portion.

18. The valve assembly according to claim 17, wherein the valve comprises a flexible hose being connected to the first end portion of the tubular element.

19. The valve assembly according to claim 17, wherein the valve member is biased towards the second position.

* * * * *